US009663896B2

(12) United States Patent
Rosengren et al.

(10) Patent No.: US 9,663,896 B2
(45) Date of Patent: May 30, 2017

(54) METHOD FOR RECOVERING HYDROLYSATE

(71) Applicant: Valmet AB, Sundsvall (SE)

(72) Inventors: Ismo Rosengren, Pori (FI); Petteri Kuusisto, Pori (FI); Lari Lammi, Pori (FI)

(73) Assignee: VALMET AB, Sundsvall (SE)

( * ) Notice: Subject to any disclaimer, the term of this patent is extended or adjusted under 35 U.S.C. 154(b) by 14 days.

(21) Appl. No.: 14/930,701

(22) Filed: Nov. 3, 2015

(65) Prior Publication Data

US 2016/0130753 A1 May 12, 2016

(30) Foreign Application Priority Data

Nov. 7, 2014 (SE) ..... 1451339

(51) Int. Cl.

| | |
|---|---|
| ***D21C 1/02*** | (2006.01) |
| ***D21C 1/00*** | (2006.01) |
| ***D21C 11/00*** | (2006.01) |
| ***D21C 7/12*** | (2006.01) |

(52) U.S. Cl.

CPC ..... *D21C 1/02* (2013.01); *D21C 1/00* (2013.01); *D21C 7/12* (2013.01); *D21C 11/00* (2013.01); *D21C 11/0007* (2013.01)

(58) Field of Classification Search

CPC ... D21C 1/00; D21C 1/02; D21C 1/04; D21C 7/12; D21C 7/06; D21C 7/08

See application file for complete search history.

(56) References Cited

U.S. PATENT DOCUMENTS

| | | | | |
|---|---|---|---|---|
| 3,294,623 | A | 12/1966 | Brinkley | |
| 5,059,284 | A * | 10/1991 | Fagerlund | D21C 7/14 162/239 |
| 5,676,795 | A | 10/1997 | Wizani | |
| 6,413,367 | B1 * | 7/2002 | Svedman | D21C 1/04 162/41 |
| 6,533,896 | B1 * | 3/2003 | Tikka | D21C 3/02 162/19 |
| 8,262,854 | B2 | 9/2012 | Uusitalo | |

(Continued)

FOREIGN PATENT DOCUMENTS

| | | | |
|---|---|---|---|
| SE | 0600678 | 3/2006 | |
| SE | WO2012158075 | 11/2012 | |
| WO | WO 2011110746 A1 * | 9/2011 | D21C 11/0007 |

OTHER PUBLICATIONS

"Mass balances of components dissolved in the pre-hydrolysis liquor of kraft-based dissolving pulp production process from Canadian hardwoods" by Abrar Saeed et al, Science Direct, Biomass and Bioenergy 39 (2012) 14-19.

*Primary Examiner* — Anthony Calandra

(74) *Attorney, Agent, or Firm* — Fasth Law Offices; Rolf Fasth

(57) ABSTRACT

The method is for producing pulp. More particularly, a displacement batch cooking process comprises recovery of a first treatment liquid by draining of the digester, preferably not using a displacement liquid. The method may preferably be used in a prehydrolysis step, wherein the recovery of the by-products is improved. In the recovery step, after the target P-factor in the prehydrolysis stage is reached, the hydrolysate is withdrawn by draining in at least one phase obtaining a strong first liquid and thereafter any residual hydrolysate may be displaced.

4 Claims, 19 Drawing Sheets

(56) References Cited

U.S. PATENT DOCUMENTS

| | | | | |
|---|---|---|---|---|
| 8,951,388 | B2 * | 2/2015 | van Lee | D21C 3/02 162/18 |
| 2006/0231222 | A1 * | 10/2006 | Bianchini | D21C 7/14 162/47 |
| 2008/0169071 | A1 * | 7/2008 | Isola | D21C 7/14 162/55 |
| 2016/0153138 | A1 * | 6/2016 | Kuusisto | D21C 3/00 162/19 |

* cited by examiner

Circulation (time for diffusion as well continuing liquid stage PH)

METHOD FOR RECOVERING HYDROLYSATE

PRIOR APPLICATION

This is a US patent application that claim priority from Swedish patent application no. SE 1451339-4, filed 7 Nov. 2014.

FIELD OF THE INVENTION

The present invention relates to a method for producing pulp. More particularly, it concerns a displacement batch cooking process recovering a first treatment liquid in a displacement batch pulping process.

BACKGROUND OF THE INVENTION

The prehydrolysis-sulfate (Kraft) cooking for the production of special pulps having a high content of alpha cellulose was developed in the 1930's, see e.g. Rydholm, S. E., Pulping Processes, pp. 649 to 672, Interscience Publishers, New York, 1968. The basic idea is to remove as much hemicellulose as possible from cellulose fibers in connection with delignification, so as to obtain a high content of alpha cellulose. This is essential because the various end uses of such pulps, dissolving pulp for instance, do not tolerate short-chained hemicellulose molecules with a randomly grafted molecular structure.

A separate prehydrolysis step permits the desired adjustment of the hydrolysis of hemicelluloses by varying the hydrolysis conditions. In the prehydrolysis-kraft cooking process the necessary delignification is not carried out until a separate second cooking step. The prehydrolysis is carried out either as a steam or water phase prehydrolysis, or in the presence of a catalyst. In the former "steam" processes, organic acids liberated from wood during the process establish the necessary pH conditions and perform a major part of the hydrolysis, whereas in the latter "water" process, small amounts of mineral acid or sulfur dioxide may be added to "assist" the prehydrolysis. In autohydrolysis the prehydrolysis stage is carried out without any addition of acids. Conventionally is autohydrolysis established at some 30-40° C. higher temperature than with acid addition.

Conventionally after prehydrolyzing the cellulosic material in a reactor, the hydrolysate and the prehydrolyzed cellulosic material are neutralized in the reactor with alkaline neutralizing liquor so as to produce neutralized hydrolysate and neutralized prehydrolyzed cellulosic material. There is hydrolysate both in the free liquid outside the chips and also trapped and immobilized inside the chips.

In Bio Pulping, as much as possible of the hydrolysate can be recovered before the neutralization step in order to be able to utilize the carbohydrates released in the prehydrolysis as an additional product from the mill. A separate washing stage, in which the digester is first filled up with a washing liquid and then the liquid containing the carbohydrates is displaced from the digester, can be used between the prehydrolysis and cooking stages.

Displacing the hydrolysate out through one end of the digester using a displacement liquid added at the other end, is the established method but has shown that the displacement front developed is nothing but perfect. Instead the perfect displacement, by an even liquid transition zone, is practically impossible to obtain as there are voids or areas in the chip volume with less packing, and especially close to the vessel wall. These voids cause the displacement liquid to penetrate faster and develop streaks of well displaced chip volumes and likewise volumes of less displaced chip volumes. As a result, the hydrolysate will become diluted with the displacement liquid sooner than expected compared with if a perfect displacement front was established.

U.S. Pat. No. 8,262,854 describes an improved method for treating lignocellulosic material, wherein the digester and its contents are first heated with direct steam to a predetermined hydrolysis temperature in a steam phase and then a small volume of washing liquid is introduced into the top of the digester which washing liquid is trickling down through the chips column and removed from the lower end of the digester. According to the process described in U.S. Pat. No. 8,262,854 the hydrolysate is recovered by utilizing trickle-bed type down-flow of hydrolysate. In this method the first fraction of the trickled-down hydrolysate is collected as a product fraction and the second fraction is discharged from the digester to a hot hydrolysate storage tank to be used as the first trickle flow liquid in the next batch. By the trickle-bed type recovery in two steps it is obtained a concentrated first hydrolysate, but the recovery step using trickling down is too slow and therefore it is disadvantageous to production capacity but also for the pulp quality. Additionally, the treatment is uneven to the contents of the digester; it is obvious that channeling will occur during the treatment, i.e. the liquid goes where it is easiest. The washing will thus be uneven trough the bed of material in the digester due to these channeling effects such that some volumes of the chip bed will be subjected to less washing. Hence, a large amount of hemicellulose rich hydrolysate may still be kept in the chip volume.

In EP 2430233 is disclosed another method to recover the hydrolysate from a steam phase prehydrolysis much quicker than that possible using the trickle down method as disclosed in U.S. Pat. No. 8,262,854. In EP 2430233 is water introduced into the digester after prehydrolysis at top and bottom and subjected to internal circulation while filling the digester. The water filling may be continued until the entire chip volume inside digester is drenched in water. The water with its content of hydrolysate is displaced by another liquid using conventional displacement and the process may continue by a neutralization cooking process known in the art.

OBJECT OF THE PRESENT INVENTION

The object of the present invention is to optimize the recovery of a first treatment liquid in a displacement batch pulping process, said first treatment liquid having highest possible concentration of valuable compounds dissolved in the first treatment liquid, avoiding excessive dilution of the first liquid and extracting largest possible volumes of this undiluted first liquid.

In a preferred application is the invention applied for recovering a hydrolysate after prehydrolysis, where the hydrolysate is kept at highest possible concentration of the hydrolysate in aspects of the carbohydrate content. By the present method the disadvantages of the prior processes can be overcome or at least diminished remarkably.

An undiluted strong first liquid may be recovered without having to use any wash liquids. Such an undiluted strong first liquid kept at high temperature is most beneficial for the heat economy of the subsequent sugar recovery process, reducing the bulk load of water in such system that needs to be reduced by distillation, evaporation or other methods.

As no sulfur containing liquids are used to displace or recover the hydrolysate it can be obtained essentially pure of sulfur.

The draining technique of the invention is preventing any dilution that may occur as the chip bed inside of digester very seldom offers a uniform flow resistance over the horizontal cross section, nor in the vertical direction. This leads to that displacement liquids often find its way through the chip bed in streaks of lowest flow resistance, i.e. causing a "channeling" effect that wash out certain chip volumes around these streaks while other parts of the chip volume is less washed out by any displacement front of wash liquids.

The invention may be applied both after steam hydrolysis, as well as liquid filled hydrolysis, but requires liquid filling after the steam hydrolysis or using the residual process liquid after liquid filled hydrolysis.

SUMMARY OF THE PRESENT INVENTION

The present invention relates to a method for recovering a first treatment liquid in a displacement batch pulping process in a digester equipped with a bottom, a top and a middle liquid exchange position, said method comprising filling the digester with a first treatment liquid. The method is characterized in that the process continues by, draining of the first treatment liquid from the digester via one of the middle or bottom liquid exchange positions in at least a first draining phase obtaining a strong first liquid;

sending at least a part of the strong first liquid to a dedicated processing position either for use in a different phase of the batch pulping process or for further processing wherein at least a part of the content of the strong first liquid is used for recovering bi-products.

In order to avoid any dilution of the first treatment liquid it is essential that at least the first phase of the recovery is done as a draining step.

The inventive method for recovering a first treatment liquid is further improved by implementation after a prehydrolysis, wherein the first treatment liquid is used during prehydrolysis of the digester content to produce an acidic hydrolysate containing the carbohydrates dissolved in the hydrolysate during the prehydrolysis. Thus after the prehydrolysis stage the process continues by, draining of the hydrolysate from the digester via one of the middle or bottom liquid exchange positions in at least a first draining phase obtaining a strong first liquid;

sending at least a part of the strong first liquid to further processing in a sugar recovery process using the carbohydrates dissolved in the hydrolysate.

The carbohydrate concentration in this strong first liquid could thus be kept at highest possible concentration, which is beneficial for the sugar recovery process.

The inventive method for recovering a first treatment liquid is further improved by implementation after a prehydrolysis, wherein after filling the digester with a first liquid during or after the prehydrolyzing step the first liquid contained in the digester is subjected to circulation within the digester by withdrawing first liquid from middle liquid exchange position and reintroduction to top and bottom of digester such that the first liquid volume passes the chip volume at least 1 time, thus washing out the carbohydrates dissolved in the hydrolysate. By this wash-out step could most of the dissolved carbohydrates be caught in the first liquid and dissolved evenly in the first liquid volume. Preferably could the displacement ratio be higher than 1 time, and up to 5-10 times, especially if the prehydrolysis is done in steam phase.

The inventive method for recovering a first treatment liquid may be further improved by implementation after a prehydrolysis, wherein the draining is assisted by displacing steam or gases trough the digester, said steam or gases added via the top liquid exchange position and wherein the pressure and temperature in the strong first liquid is maintained. The use of steam, preferably low pressure steam, will not dilute the first liquid as the temperature in the prehydrolyzed material is high and above the condensation point of the steam. This will also speed up the draining phase and increase the recovered volume of the strong first liquid.

The inventive method for recovering a first treatment liquid is further improved by implementation after a prehydrolysis, wherein draining is done by withdrawing the strong first liquid trough middle liquid exchange position and in final phases displacing the residual strong first liquid kept in the digester below middle liquid exchange position via a displacement using hot water added to bottom liquid exchange position displacing the residual strong first liquid out through middle liquid exchange position. This will limit risks for dilution of the residual strong first liquid as the displacement is only performed in a small volume of the digester, and channeling effects will have less impact on distortion of the displacement front trough the comminuted cellulose material kept in the digester.

The inventive method for recovering a first treatment liquid is further improved by implementation after a prehydrolysis, wherein the strong first liquid is kept at the prehydrolysis temperature and stored in accumulator tank before processing in a sugar recovery process using the carbohydrates dissolved in the hydrolysate. This is most beneficial for the sugar recovery process and the heat economy of the process, as initial phases is focused upon increasing the concentration of carbohydrates, using distillation or evaporation processes, and further conversion of carbohydrates to monomers of sugar, which requires further heat treatment, for ethanol production or other processes.

The inventive method for recovering a hydrolysate is further improved by after finished draining of the first treatment liquid and obtaining the strong first liquid is the digester filled with hot water again until the volume of comminuted cellulosic material is submerged in hot water, where after the hot water content is subjected to circulation such that the hot water volume is circulated at least 1 time, draining of the hot water volume from the digester via one of the middle or bottom liquid exchange positions in at least a second draining phase obtaining a weak second liquid;

sending at least a part of the weak first liquid to a dedicated second accumulator to be used as the first treatment liquid ahead of prehydrolysis in a subsequent batch cycle.

This second wash out phase may catch the residual carbohydrates wetting the drained comminuted cellulose material, and during circulation will displace some of residuals bound in the comminuted material. As the batch digester is filled a second time with hot wash water, the concentration of the carbohydrates will be considerably lower than in the strong first liquid and this weak hydrolysate may be used as the first liquid in a following batch cycle, such that the carbohydrate content in the first liquid is already elevated at initial filling of the digester, and thus may increase the carbohydrate yield in the drained first liquid.

BRIEF DESCRIPTION OF THE FIGURES

The present invention is described by a sequential process disclosed in FIGS. 2 to 19; wherein.

BACKGROUND PRIOR ART AND DEFINITIONS USED IN THIS DESCRIPTION

Figure 1:
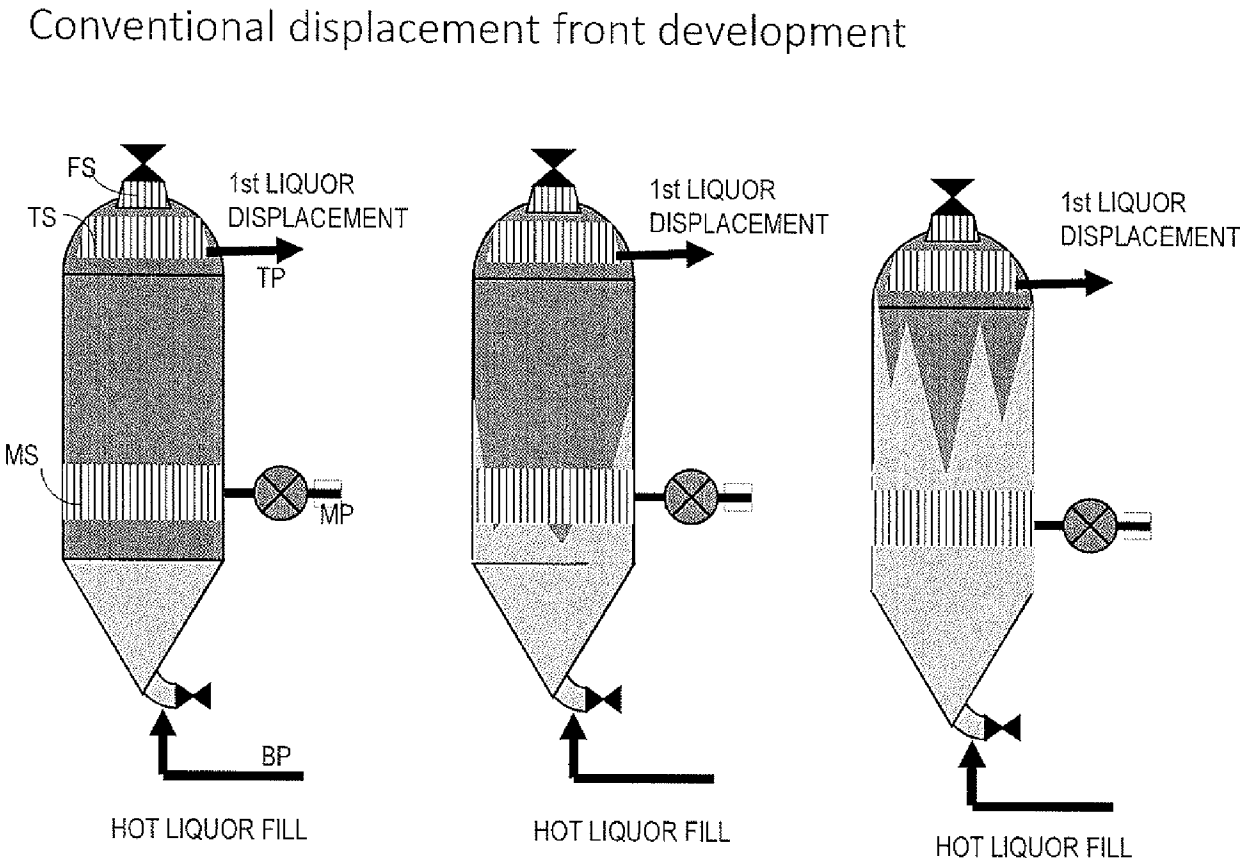
FIG. 1 shows how a conventional liquid displacement front is developed through the batch digester.

In FIG. 1 is shown a conventional displacement cycle in a batch digester, where a $1^{st}$ liquor is displaced via a top screen TS by adding a $2^{nd}$ displacement liquor via an inlet in the bottom.

The batch digester includes a bottom, a top and a middle liquid exchange position.

The bottom liquid exchange position includes at least an inlet for adding different liquors, and conventionally there may be dedicated inlets for each type of liquors or steam to be introduced.

The mid liquid exchange position includes at least a mid screen MS which is the essential withdrawal position used when withdrawing and circulating the cooking liquor, but the screen may also be used for adding treatment liquors or steam. Using the mid screen also as a distributor in special phases helps to keep the screen open. A pump is located in the withdrawal line from the mid screen, and if filled grey as in FIG. 1, the pump is shut off.

In commercial batch digesters of today, the volume of the digester is about 300 $m^3$, which of course may vary dependent on intended capacity of the digester. In such a digester the mid screen is typically located in lower ⅓ of the digester, with a volume of 100 $m^3$ below mid screen and thus 200 $m^3$ above mid screen.

The top liquid exchange position includes at least one feed screen FS in chip inlet and a larger top screen TS. The feed screen is a steam injector of a well known design that adds a swirling motion to the inflow of comminuted cellulose material during filling such that an even upper surface of comminuted cellulose material is obtained. The top screen is a screen used to withdraw gases but also withdrawing displaced liquors.

The three figures show from left to right show how the displacement front is developed inside the batch digester during the displacement process. In the first phase, left figure, is hot liquor added, and here filling the entire bottom cone part, as displacement liquor to bottom of digester will displace the $1^{st}$ liquor out through the top.

In the second phase, middle figure, is the displacement front moving upwards as more hot liquor is added and as indicated is the displacement front no longer a perfect horizontal displacement front, but instead are streaks of hot liquor penetrating the chip volumes faster than in other areas. This applies especially to the chip volumes close to digester wall.

In a later phase, right hand figure, is shown how these streaks of hot liquor reach the top screen while still large volumes of the chip content lower down in digester has not been displaced at all. This effect is resulting in a dilution of the displaced $1^{st}$ liquor sooner than expected compared to if the displacement front had a perfect horizontal front without these streaks.

This example of prior art show the conventional displacement of a $1^{st}$ liquid with a different $2^{nd}$ liquid, and the $2^{nd}$ liquid here is hot liquor.

Only one digester is shown but typically are a number of digesters used operated in sequence and thus in different phases of the cook. If for example 5 digesters are operated the first digester is started and then the remaining digesters are started at some time interval which time interval may correspond to ⅕ of the total cooking cycle time for one digester. Cooked pulp may then be blown to a blow tank at regular intervals, and the process liquids stored in accumulators and atmospheric tanks may be used in another digester minimizing inactive dwell time for the liquids used. The piping system is simplified showing only one liquid addition point for WL, Wash filtrate, LP_ and MP-steam but in a real system are individual piping connected to the the digester.

DETAILED DESCRIPTION OF THE PRESENT INVENTION

The present invention may be applied to any batch cooking phase where the $1^{st}$ liquid needs to be kept in an undiluted form at largest possible volumes. Hence, the $1^{st}$ liquid may be a hydrolysate or any other process liquid that catch dissolved compounds from the comminuted cellulosic material treated in the batch digester. However, the first liquid may also be warm or hot liquor from a preheating sequence ahead of any type of cook. The first liquid may also be different impregnation liquors or liquids containing polysulfide, anthraquinone, CCE filtrate or similar.

In following figures are shown a sequential prehydrolysis process ahead of a kraft cook, where the invention is applied in the phase of recovering the hydrolysate after prehydrolysis. For further processing of the hydrolysate it is essential that the hydrolysate has as high carbohydrate content as possible, catch as much as possible of the dissolved carbohydrates, while avoiding dilution of the hydrolysate with water or chemicals that may hamper the recovery process. High water content reduces the heat economy of the subsequent recovery process.

A Prehydrolisis Kraft Process Batch Sequence

Figure 2:
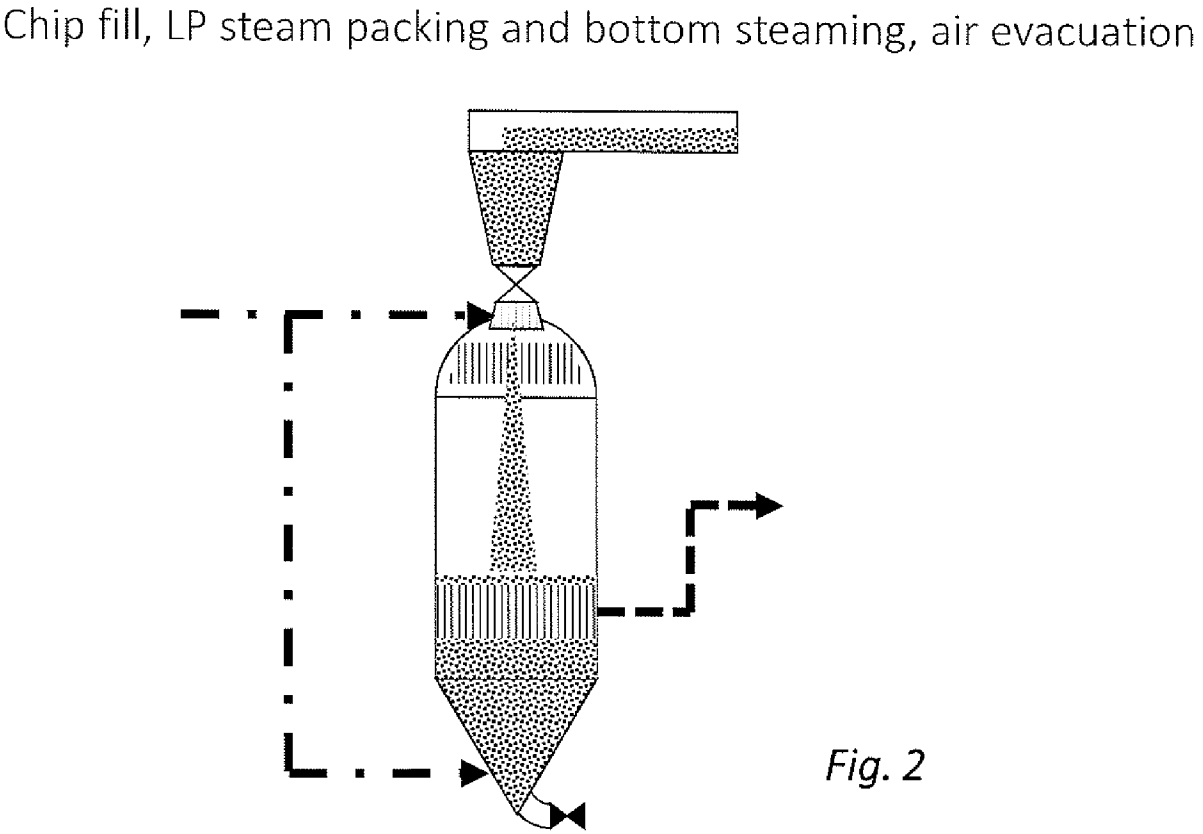
FIG. 2 shows the first chip filling phase with low pressure steam distribution and heating.

In FIG. 2 is shown the very first phase of batch cooking, where comminuted cellulose material is fed into digester during low pressure steam addition trough top and bottom liquid exchange positions, and venting gases trough middle point liquid exchange position. The steam added to top is injected using a conventional swirl inducing inlet that helps spreading the comminuted cellulose material in an even layer inside digester.

Figure 3:
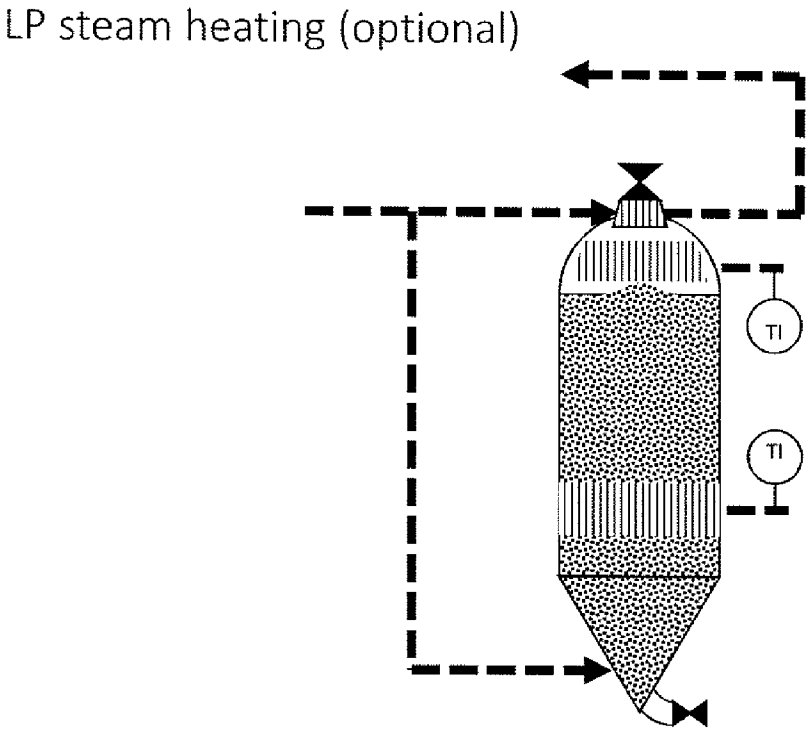
FIG. 3 shows an optional first heating phase of the filled digester using low pressure steam.

In FIG. 3 is shown an optional extension of the low pressure steam heating in a filled digester heating the comminuted cellulose material towards the condensation point of the low pressure steam, typically at some 130-140° C. at the most.

Figure 4:
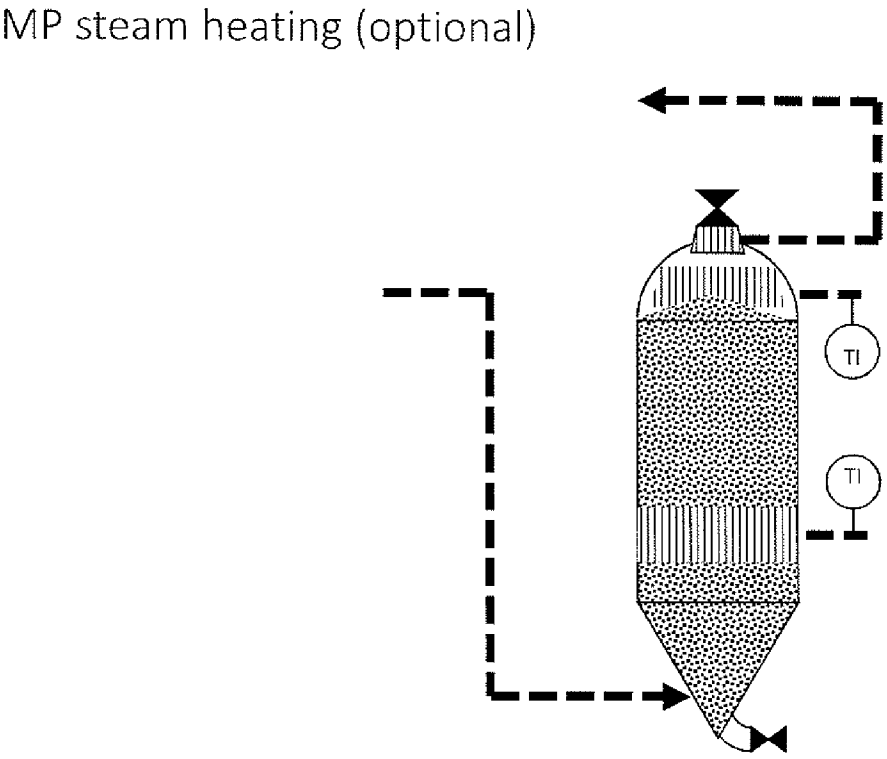
FIG. 4 shows an optional subsequent second heating phase using medium pressure steam.

In FIG. 4 is shown an optional final steam heating phase where the filled digester is heated towards full prehydrolysis temperature using medium pressure steam.

Figure 5:
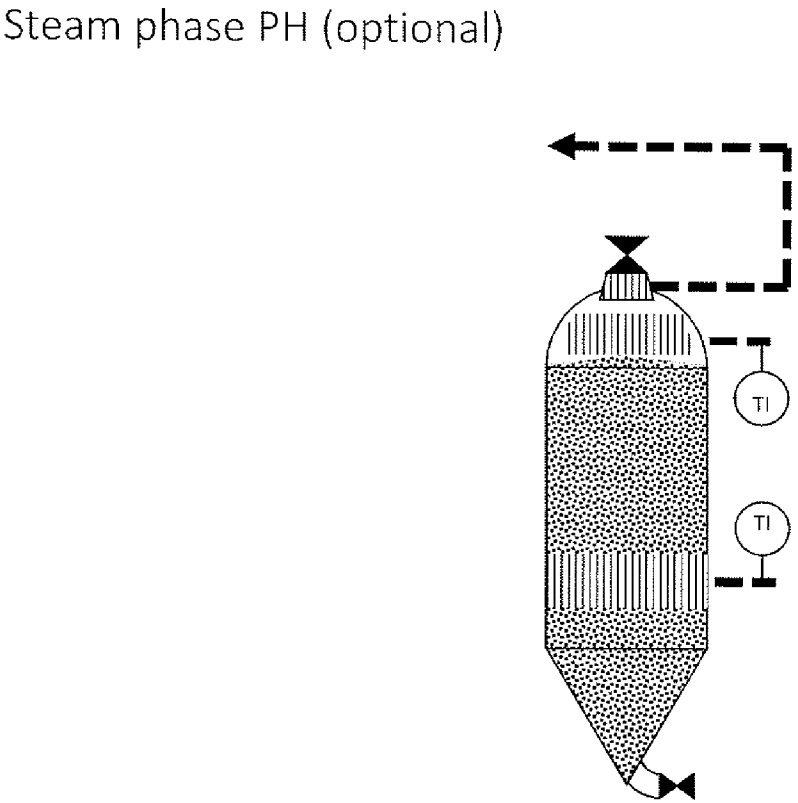
FIG. 5 shows an optional prehydrolysis stage in steam phase.

In FIG. 5 is shown an optional steam phase prehydrolysis, where the temperature is maintained for a sufficient time to subject the material in the digester to full hydrolysis, i.e. reaching the necessary P-factor.

Figure 6:
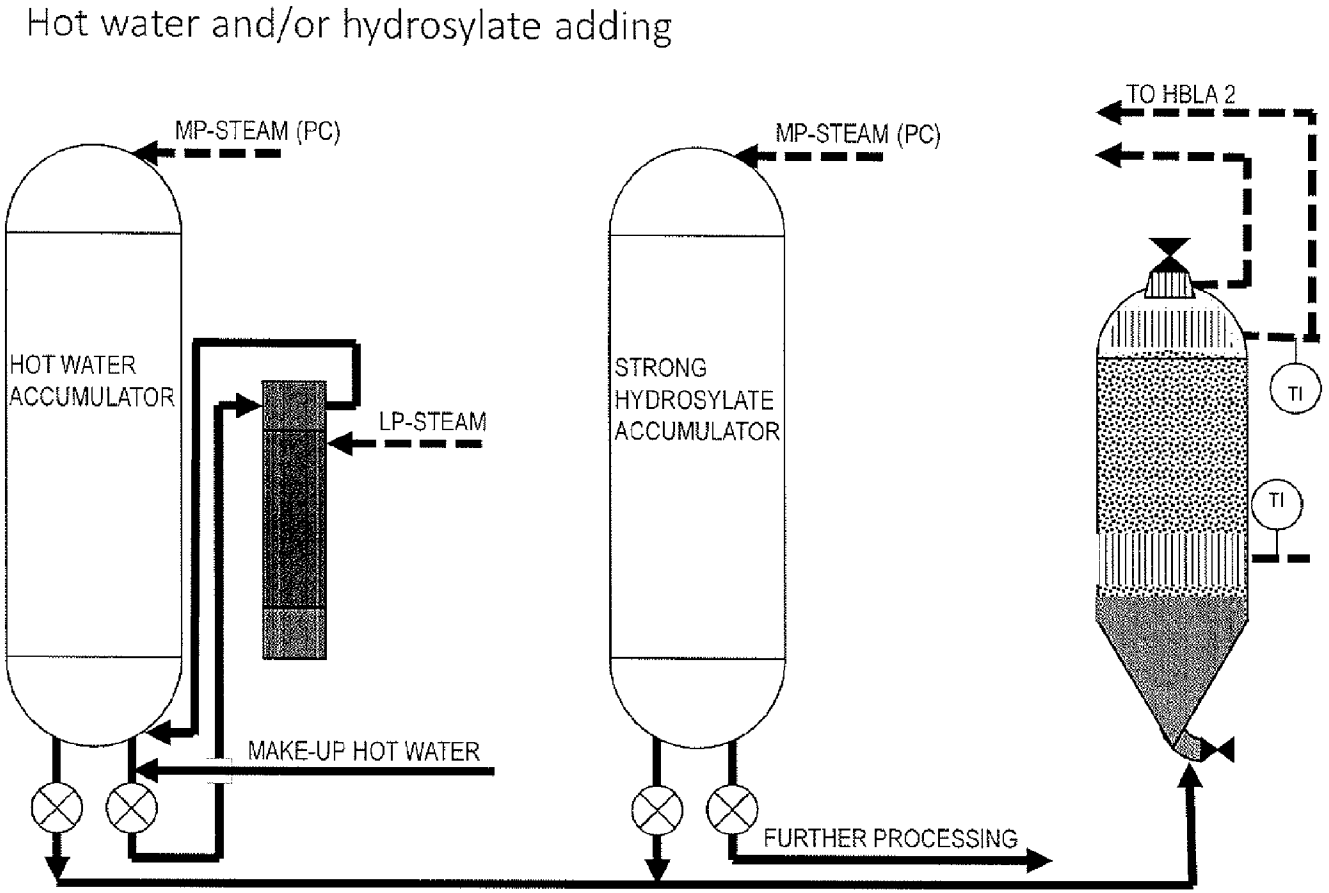
FIG. 6 shows the start of the hot water or hydrolysate filling of the digester.

In FIG. 6 is shown filling of the digester with hot water and/or hydrolysate, which could be done directly after FIG. 2, 3 or 4 or alternatively after a steam phase prehydrolysis shown in FIG. 5. Thus, water or hydrolysate is introduced to bottom liquid exchange position until the liquid level cover the comminuted cellulose material inside the digester.

Figure 7:
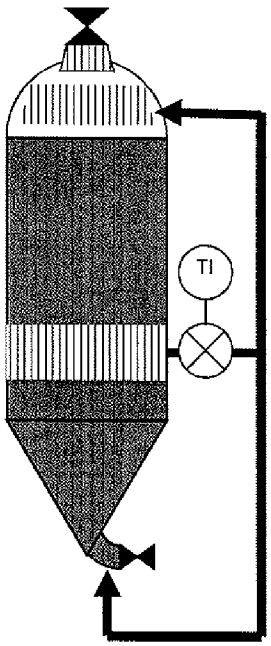
FIG. 7 shows the circulation phase of the hot water or hydrolysate filled digester.

In FIG. 7 is shown a subsequent circulation phase in the digester where the treatment liquid is withdrawn from middle liquid exchange position and reintroduced to both top and bottom liquid exchange position. If this is a wash-out phase after steam phase hydrolysis (FIG. 5), the circulation ratio of the treatment liquid may be well over 1.5 times the total volume of the treatment liquid, possibly up to 5-10 times, especially if the prehydrolysis is done in steam phase. If this is the establishment of a water filled prehydrolysis, the digester will be kept at this temperature and pressure until the prehydrolysis step is completed, i.e. the required P-factor has been reached. P-factor is a defined factor to control the prehydrolysis stage, taking the temperature and time into account (as e.g. H-factor); Herbert Sixta, Handbook of Pulp, Volume 1, Wiley-VCH Verlag, 2006, pages 343-345.

Figure 8:
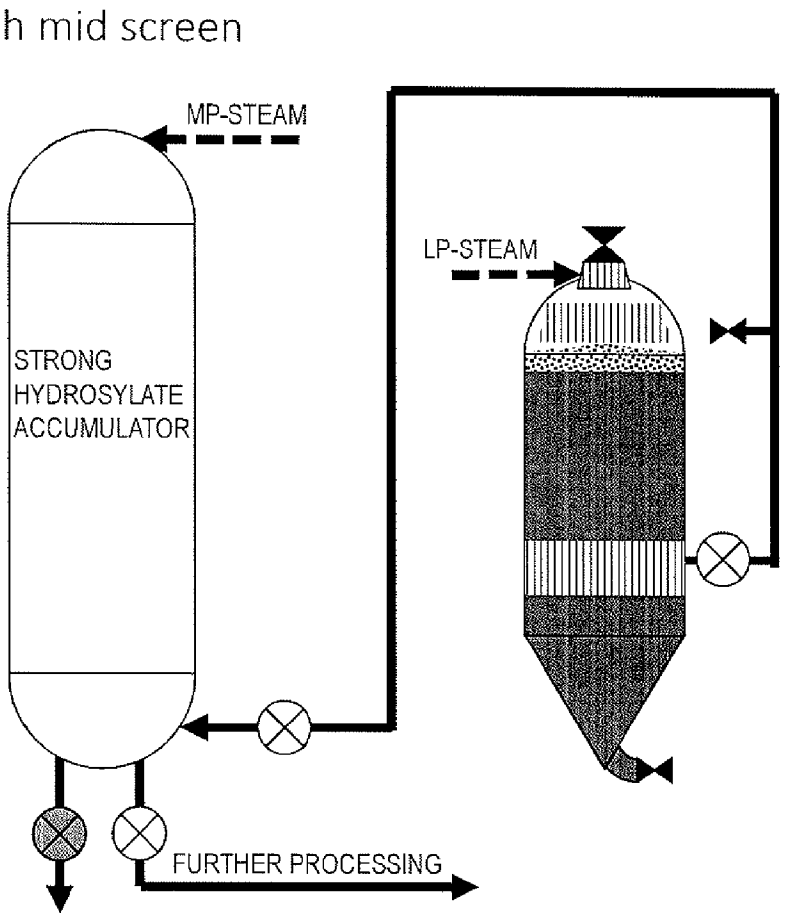
FIG. 8 shows the first phase of the inventive draining of the digester via mid screen withdrawal.

In FIG. 8 is shown the inventive recovery of the first treatment liquid, which after prehydrolysis is the hydrolysate. Recovery starts with draining the hydrolysate from at least the middle liquid exchange position, and sending the hydrolysate to a strong first liquid accumulator. As shown, the draining may be assisted by adding a hot displacement gas through the digester, such as LP steam. A compressor may assist this displacement gas but the important thing is that no larger volumes of displacement liquids are used. As the comminuted cellulose material are at full prehydrolysis temperature essentially no volumes of condensate is formed using low pressure steam, which may dilute the hydrolysate.

Alternatively could the draining be done without steam addition, and in such case is the pressure reduced while lowering the liquid level, and the liquor will flash off primarily steam in the void above liquor level.

The recovered strong first liquid is thereafter sent to processing in a sugar recovery process using the carbohydrates dissolved in the hydrolysate.

Figure 9:
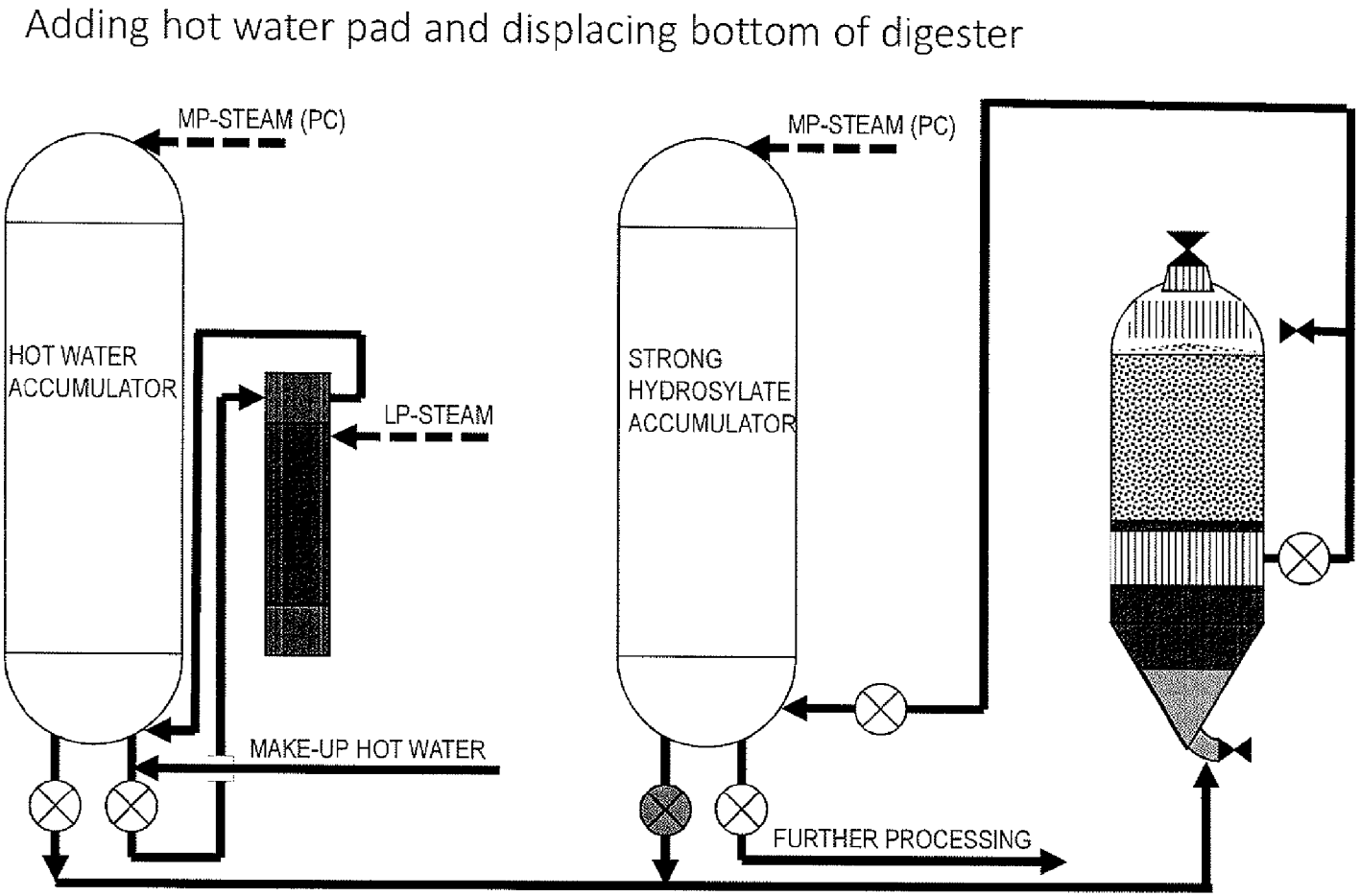
FIG. 9 shows the final displacement of residual hydrolysate below mid screen using displacement with hot water.

As shown in FIG. 9 is the draining continued until the hydrolysate level is approaching the middle liquid exchange position and the residual volume of hydrolysate kept below the middle liquid exchange position is displaced by adding hot water to the bottom liquid exchange position. The addition of hot water may continue until the hydrolysate is displaced and withdrawn from mid screen to such an extent that the hydrolysate starts to become diluted, which may be detected by a pH or conductivity sensor in withdrawal outlet. As it is only the lower part of the digester that is subjected a displacement, the order of dilution of the hydrolysate is reduced considerably compared with a displacement of the entire batch volume.

Optional $2^{nd}$ Wash

Figure 10:
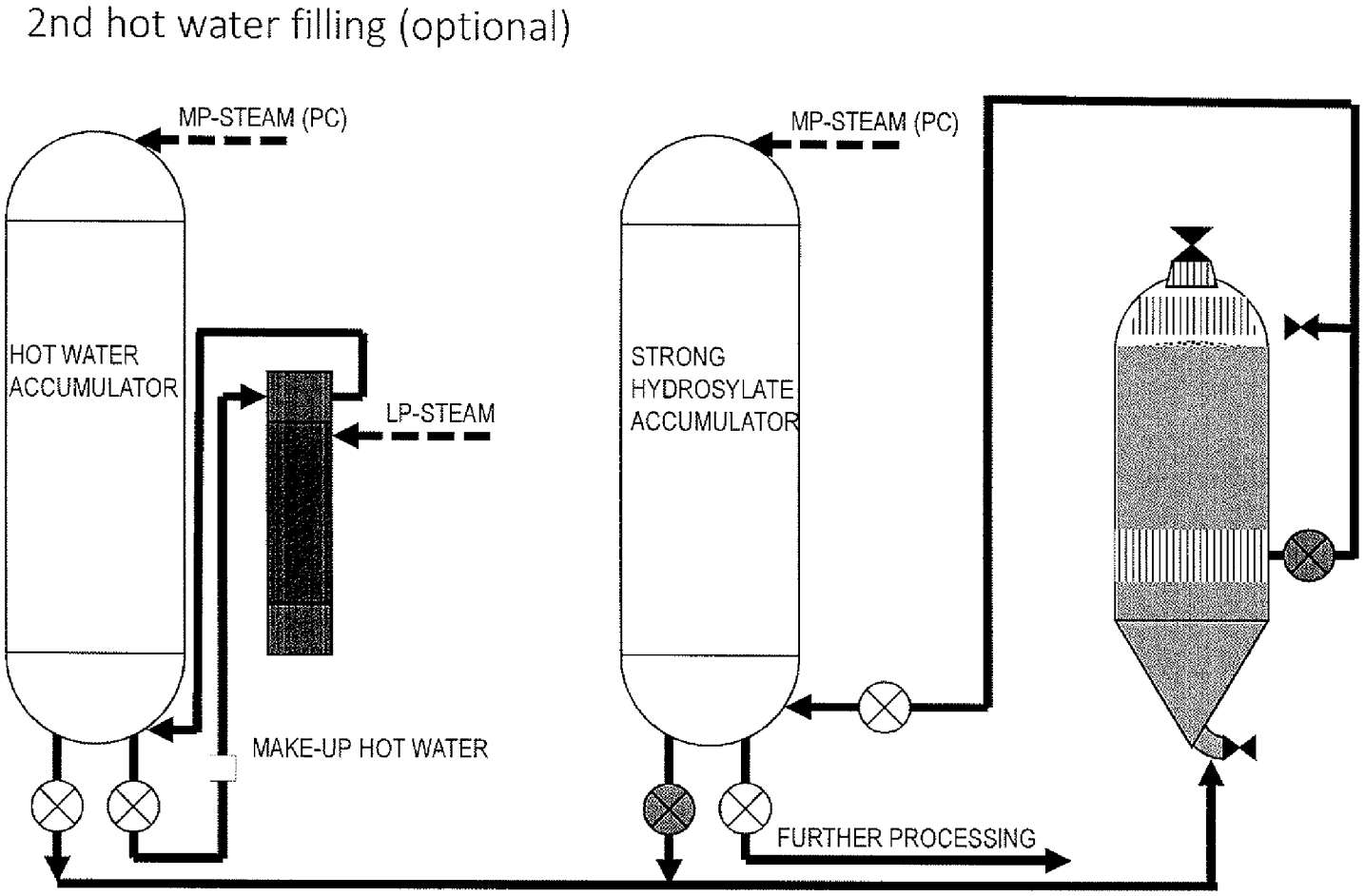
FIG. 10 shows an optional $2^{nd}$ hot water filling.

After withdrawal of the hydrolysate in FIG. 9, could a second optional wash continue, which purpose is to catch the part of hydrolysate that is wetting the surface of the comminuted material in the digester, as well as enable a diffusion of a part of the hydrolysate that is bound in the comminuted material. As shown in FIG. 10 could then the supply of hot water continue until the volume of comminuted material is submerged in hot water.

Figure 11:
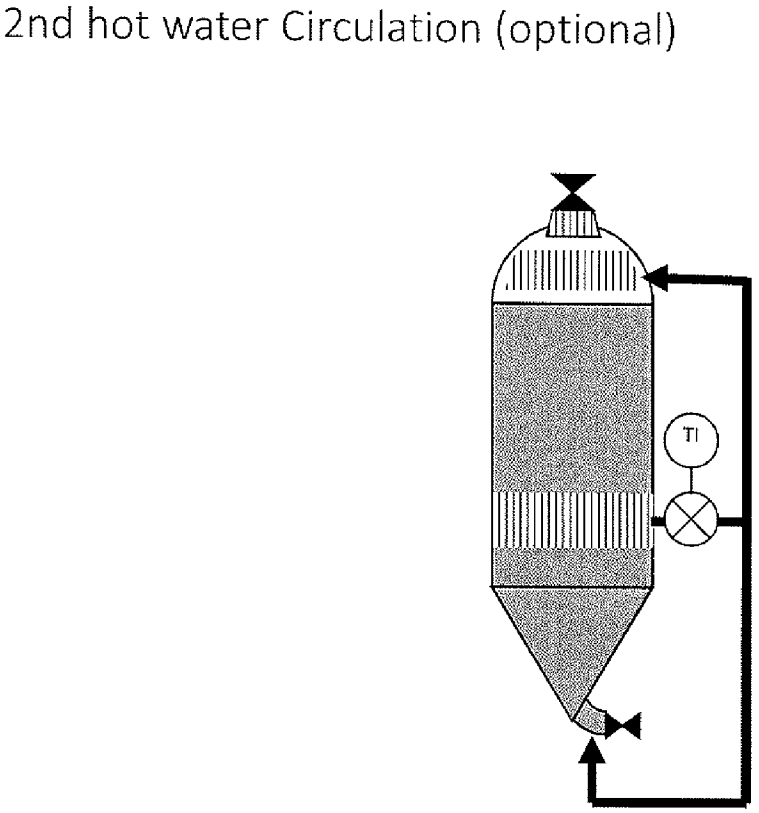
FIG. 11 shows an optional circulation following the $2^{nd}$ hot water filling.

In FIG. 11 is then shown a circulation phase where the hot water is withdrawn from mid screen and recirculated to top and bottom. Such an intensified liquid circulation may leach out more of the hydrolysate bound in the comminuted material.

Figure 12:
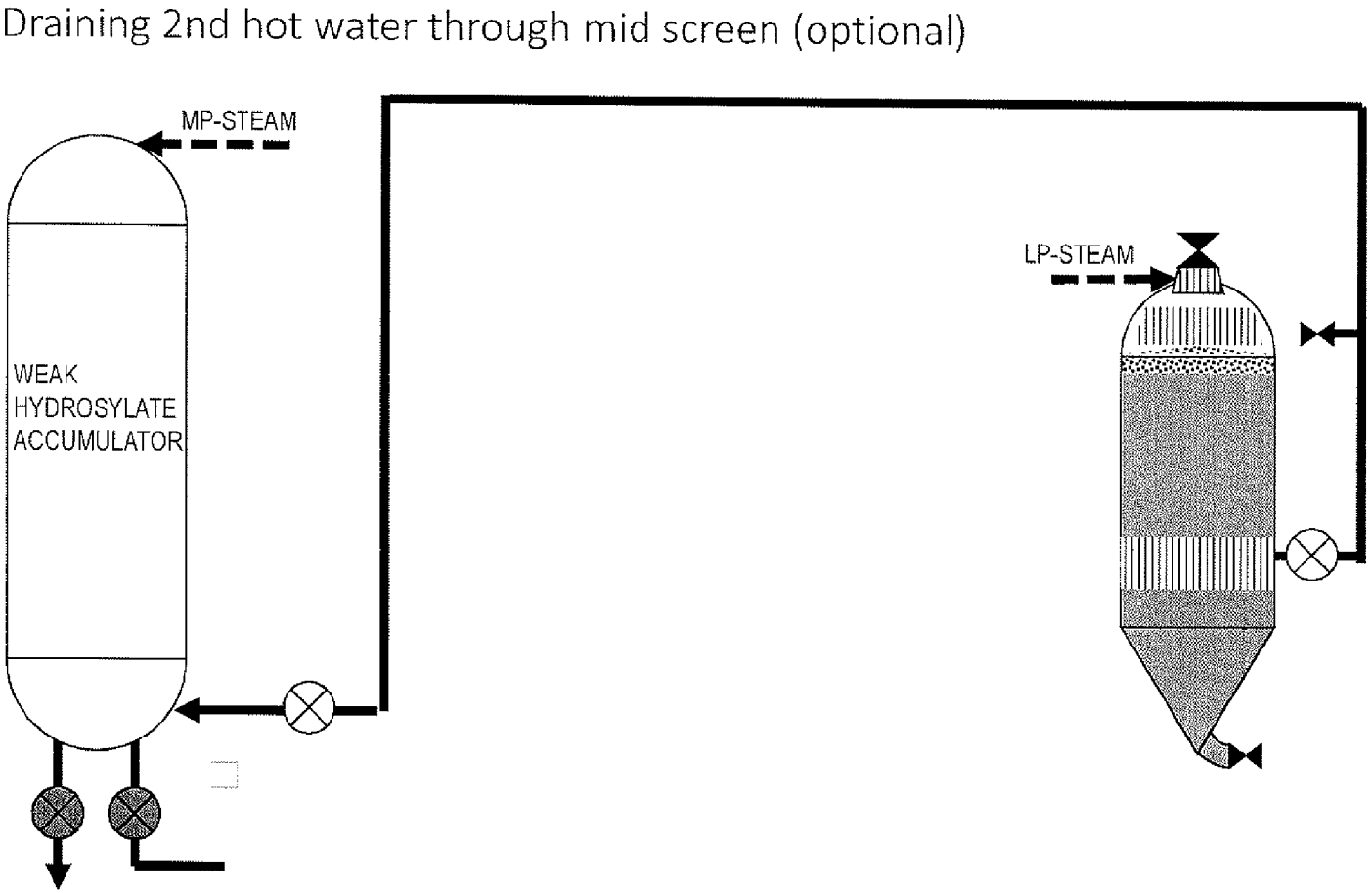
FIG. 12 shows an optional mid screen draining of the circulated $2^{nd}$ hot water.

The optional second wash is then as shown in FIG. 12 ended by draining the weaker hydrolysate to a dedicated weak hydrolysate accumulator.

The weak hydrolysate may preferably be used for filling the digester ahead of a liquid filled prehydrolysis, or as wash liquid after a steam phase hydrolysis.

This optional wash requires an extra dedicated accumulator tank for storing the weak hydrolysate, and is only considered in mills where the yield of carbohydrates is optimized at expense of investment costs for the extra accumulator.

Neutralizing Phase

Figure 13:
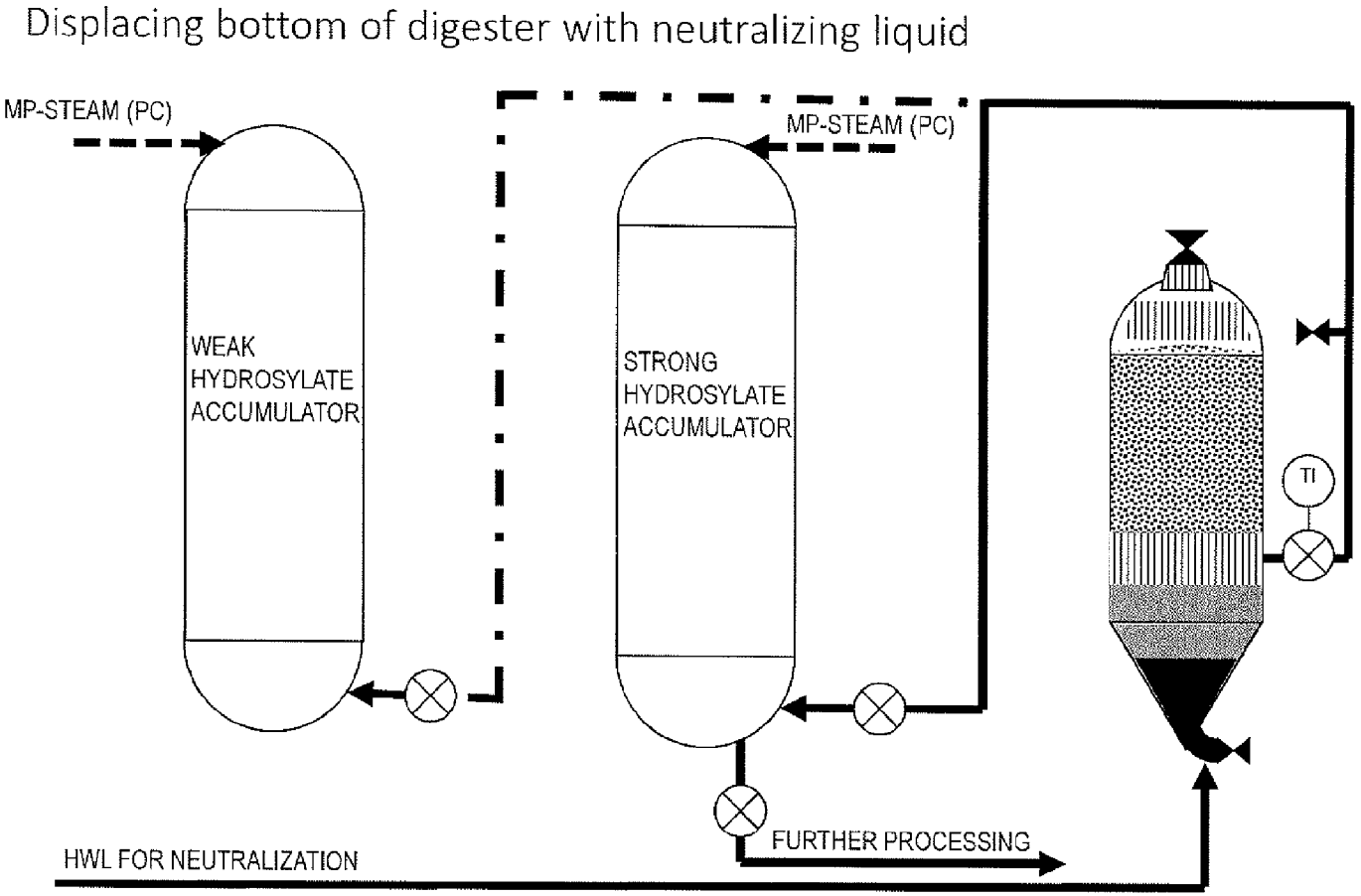
FIG. 13 shows the next phase with displacement of the residual $2^{nd}$ hot water volume with neutralizing hot white liquor.
Figure 14:
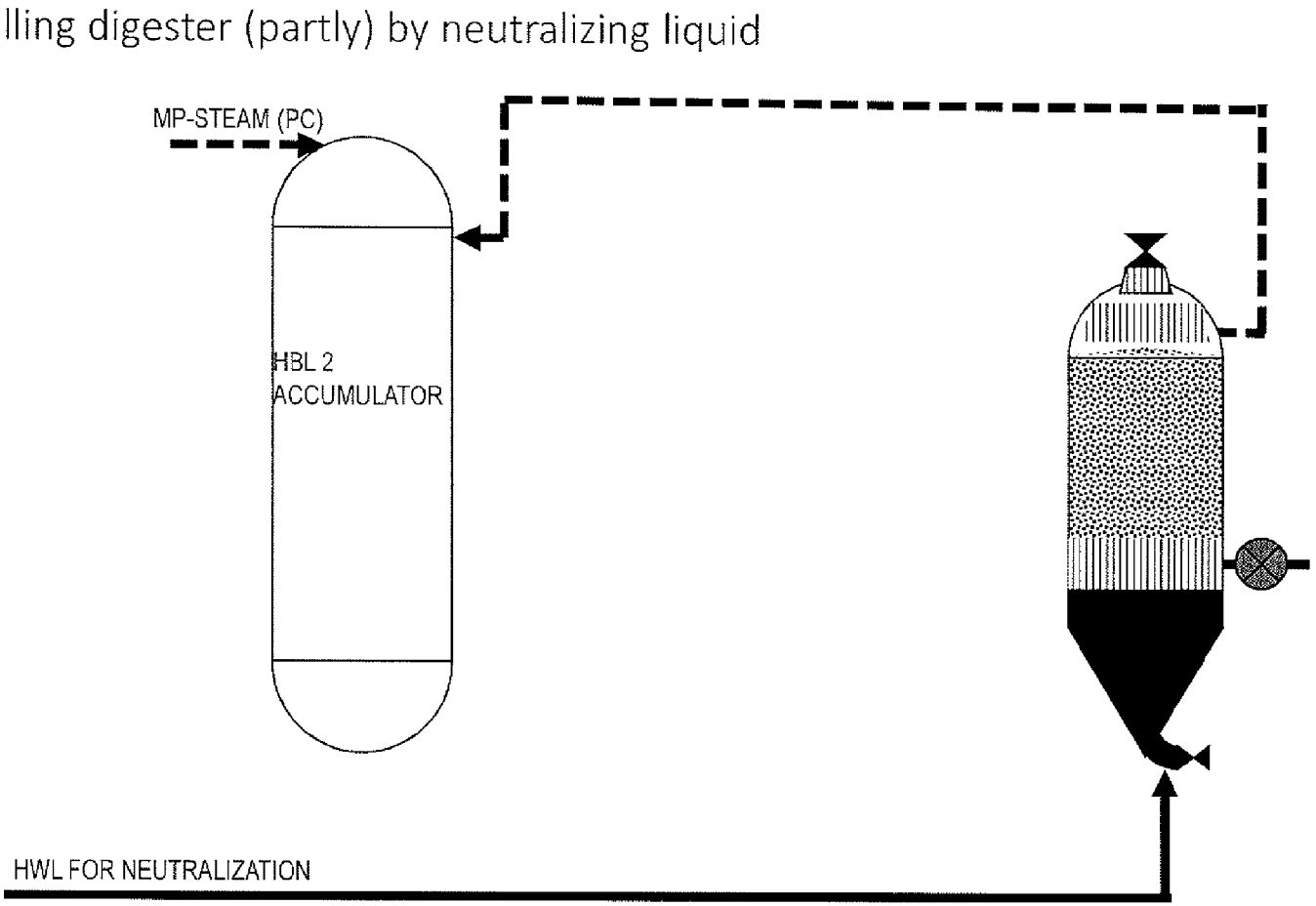
FIG. 14 shows how the $2^{nd}$ hot water volume has been displaced with hot white liquor.
Figure 15:
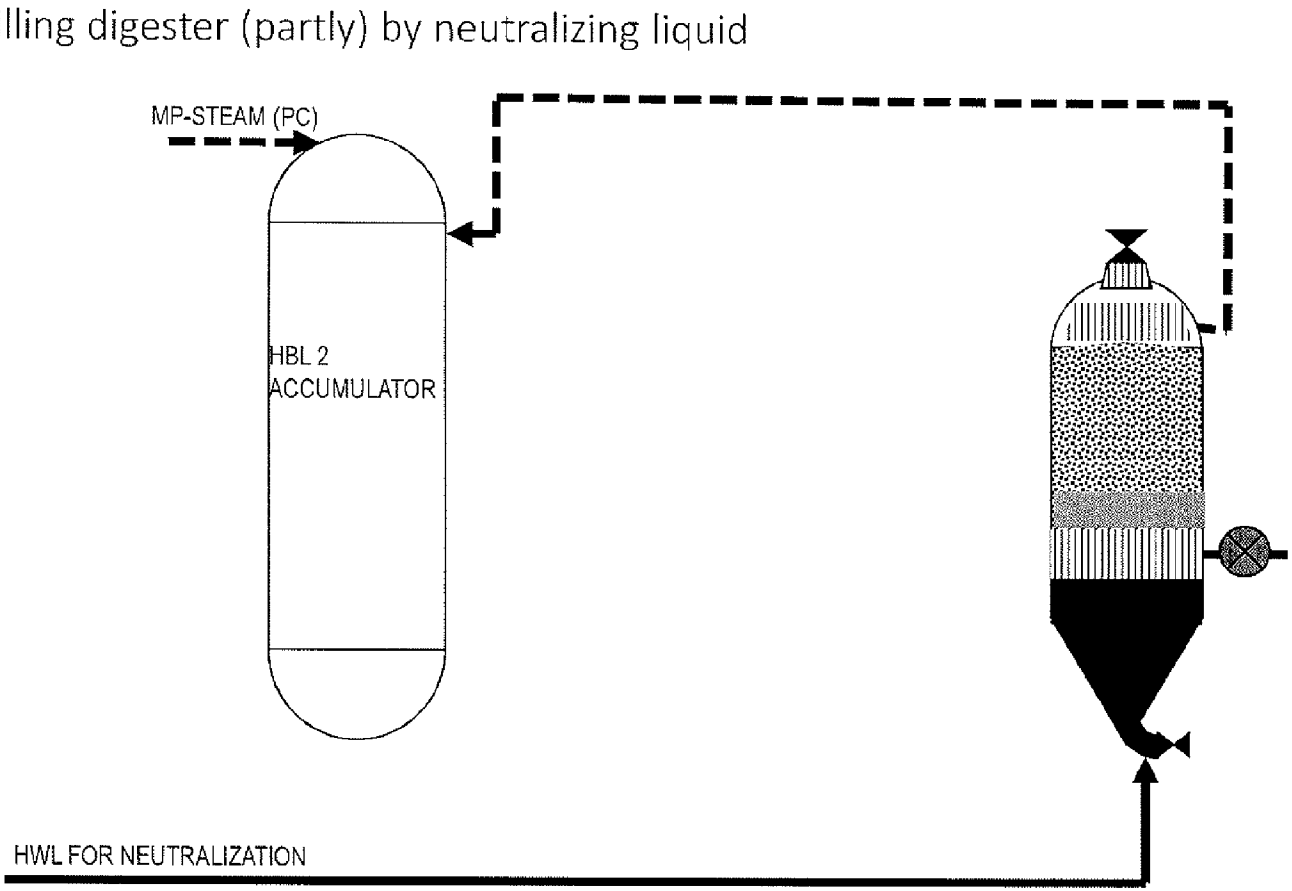
FIG. 15 shows how the hot white liquor pad is further filling the digester.

In FIG. 13 is shown the start of the neutralizing phase, where hot white liquor HWL is added to digester in order to swing the pH of the content from acidic conditions to alkaline. The hot white liquor (black in figure) is only added in an amount partially filling the digester, forming a hot white liquor pad. As shown in FIG. 13 is the residual weak hydrolysate withdrawn in mid screen and may be directed to the weak hydrolysate accumulator, until the white liquor pad reaches the mid screen as seen in FIG. 14. In FIG. 15 is shown how the white liquor pad further displace a residual volume of weak hydrolysate upwardly.

Figure 16:
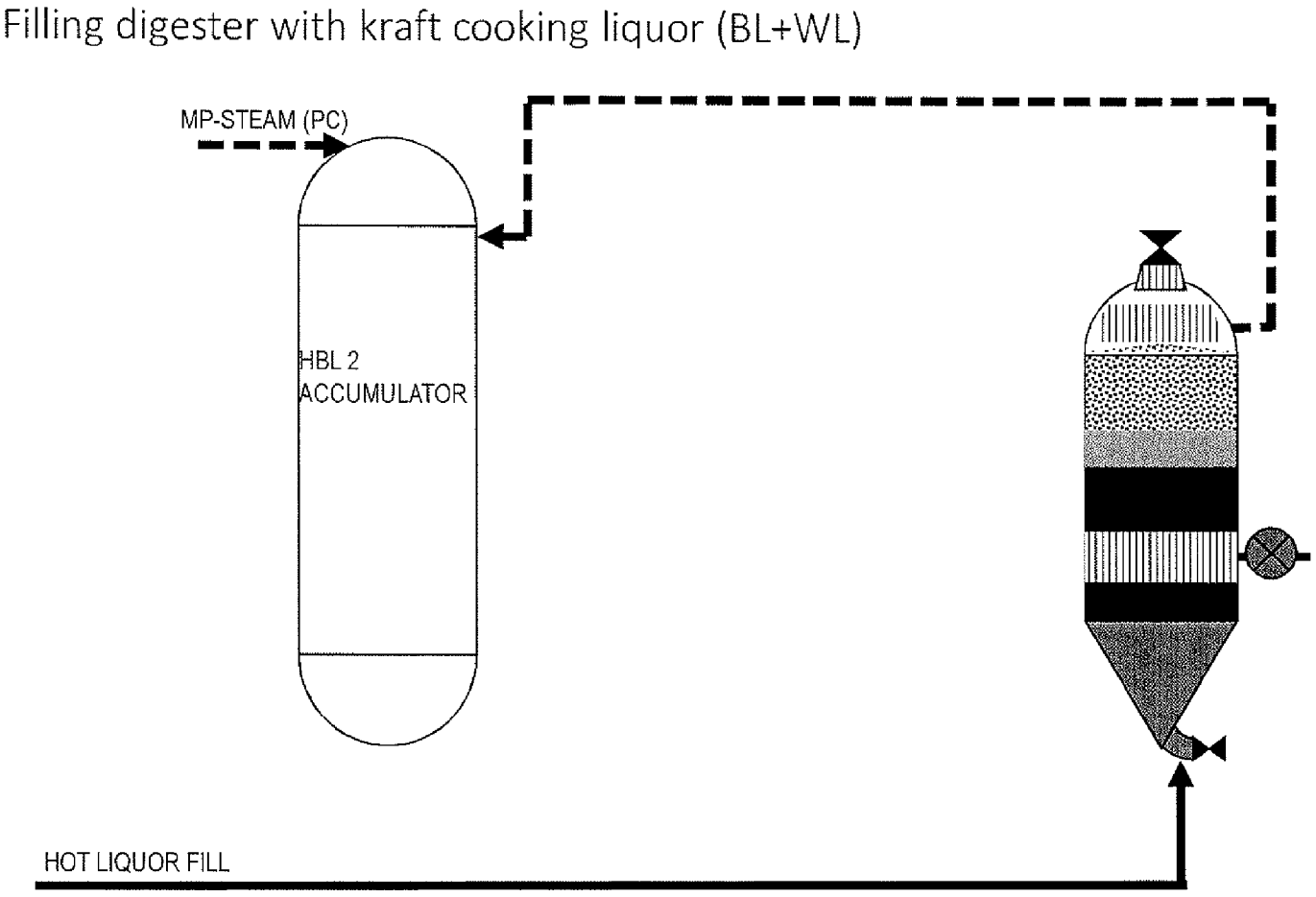
FIG. 16 shows the next phase starting with hot liquor fill, displacing the hot white liquor pad upwards through the digester volume.

Directly after this volume of hot white liquor is added hot liquor fill as shown in FIG. 16. The pad with hot white liquor (black in figure) is pushed upwards swinging the pH to alkaline conditions ahead of the hot liquor filling, the latter having the substantial charge of alkali for the subsequent kraft cook.

Figure 17:
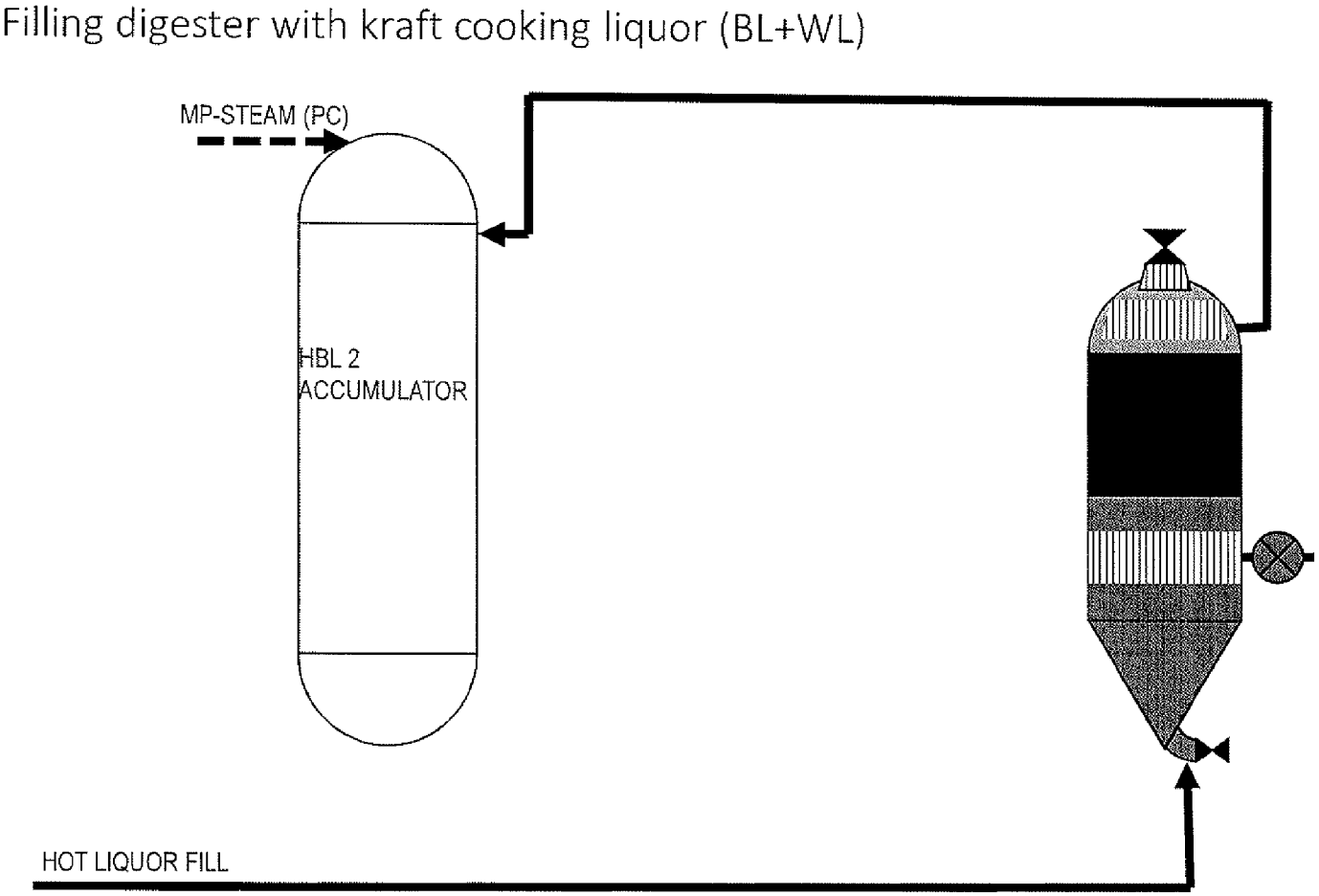
FIG. 17 shows how hot liquor fill is displacing the hot white liquor pad upwards while the residual hot water pad is displaced to HBL 2.
Figure 18:
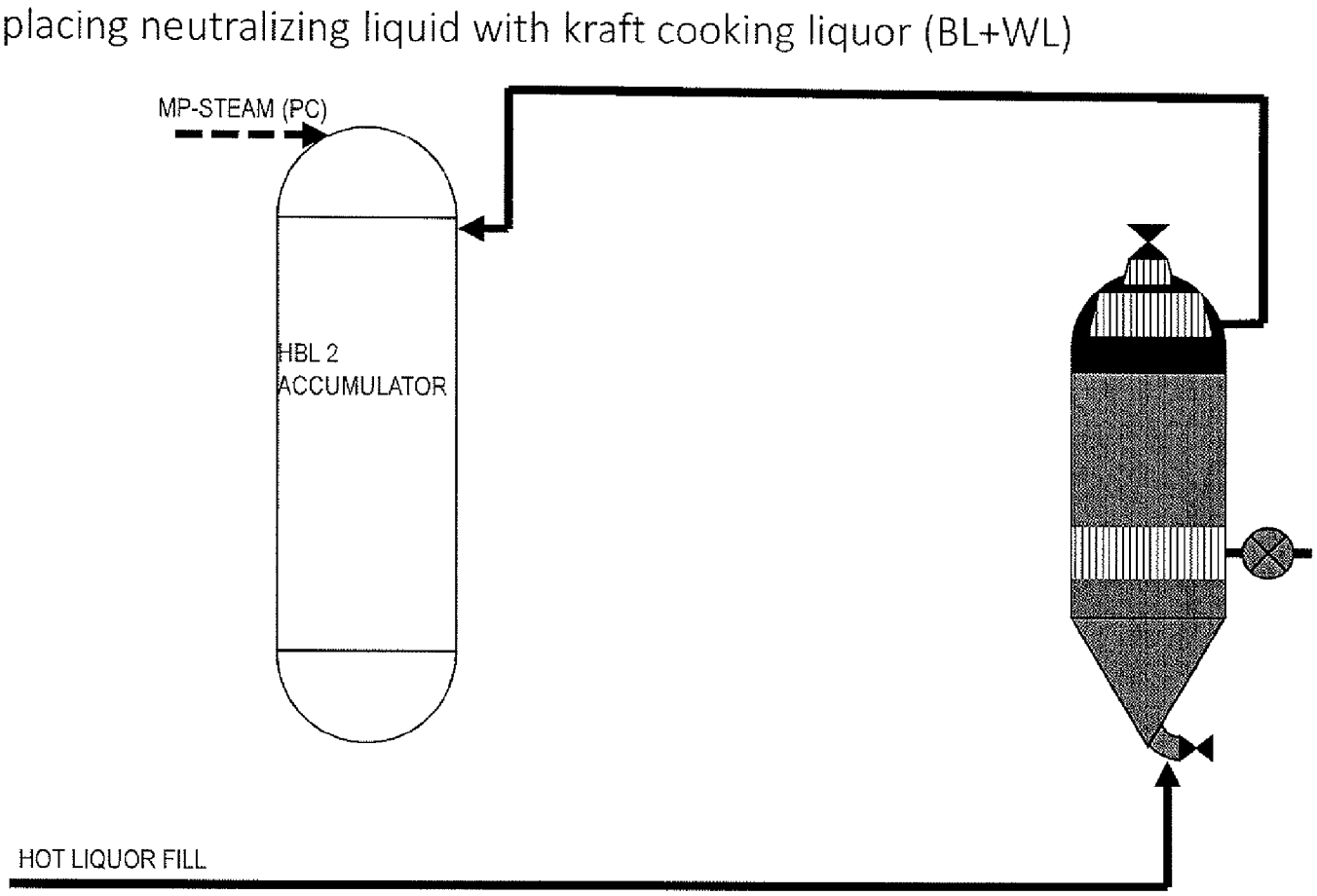
FIG. 18 shows how hot liquor fill is displacing the residual hot white liquor pad to HBL 2.

At the end of the neutralizing phase is the residual wash water displaced to HBL accumulator, as shown in FIG. 17, and the consumed hot white liquor is also displaced to the HBL accumulator, as shown in FIG. 18.

Start of Kraft Cook

Figure 19:
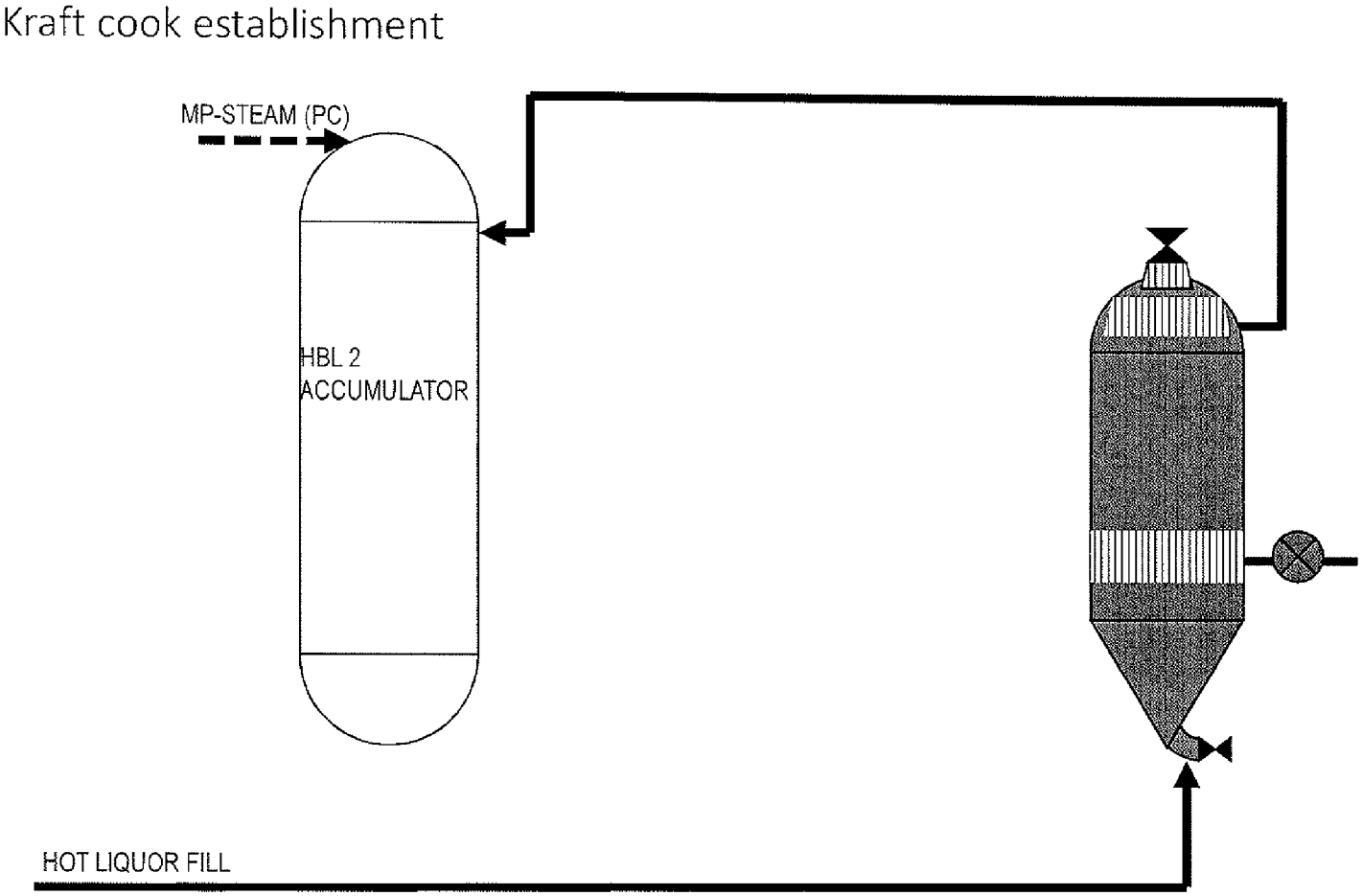
FIG. 19 shows the digester has been filled completely with hot liquor ahead of the subsequent kraft cook.

In FIG. 19 is shown how the entire digester finally is filled with Hot Liquor, i.e. the right proportions of black and white liquor necessary for the kraft cook. And the kraft cook continues during circulation similar to that shown in FIG. 7 or 11 but is not disclosed in detail here.

While the present invention has been described in accordance with preferred compositions and embodiments, it is to be understood that certain substitutions and alterations may be made thereto without departing from the spirit and scope of the following claims.

We claim:

1. A method for recovering a first treatment liquid in a displacement batch pulping process in a digester filled with comminuted cellulosic material and equipped with a bottom, a top and a middle liquid exchange position, said method comprising:

filling the digester with a first treatment liquid during or after a steam prehydrolyzina step wherein the process continues by, after filling the digester with the first treatment liquid during or after the prehydrolyzing step, subjecting the first treatment liquid contained in the digester to circulation within the digester by withdrawing the first treatment liquid from the middle liquid exchange position and reintroducing the withdrawn first treatment liquid to a top and a bottom of the digester, passing the first treatment liquid through the comminuted cellulosic material disposed in the digester at least once, and washing out the carbohydrates dissolved in the hydrolysate;

in a first draining phase, draining the first treatment liquid from the digester via one of the middle or bottom liquid exchange positions to obtain a strong first liquid; and sending at least a part of the strong first liquid to a dedicated processing position either for use in a different phase of the batch pulping process or for further processing wherein at least a part the strong first liquid is used for recovering by-products wherein the first treatment liquid is used during prehydrolysis of the comminuted cellulosic material to produce an acidic hydrolysate containing the carbohydrates dissolved in the hydrolysate during the prehydrolysis and wherein after the first draining phase at least a part of the strong first liquid is sent to further processing in a sugar recovery process by using the carbohydrates dissolved in the hydrolysate, and wherein the first draining phase is assisted by displacing steam or gases through the digester, the steam or gases being added via the top liquid exchange position and wherein a pressure and a temperature of the strong first liquid is maintained.

2. The method for recovering a first treatment liquid according to claim 1, wherein the first draining phase comprises the step of withdrawing the strong first liquid through the middle liquid exchange position and in final phases displacing a residual strong first liquid kept in the digester below the middle liquid exchange position via a displacement by using water added to the bottom liquid exchange position to displace the residual strong first liquid out through the middle liquid exchange position.

3. The method for recovering a first treatment liquid according to claim 1, wherein the strong first liquid is kept at a prehydrolysis temperature and stored in a dedicated accumulator tank before processing the strong first liquid in a sugar recovery process by using the carbohydrates dissolved in the hydrolysate.

4. A method for recovering a first treatment liquid in a displacement batch pulping process in a digester filled with comminuted cellulosic material and equipped with a bottom, a top and a middle liquid exchange position, said method comprising:

filling the digester with a first treatment liquid during or after a steam prehydrolyzing step wherein the process continues by, after filling the digester with the first treatment liquid during or after the prehydrolyzing step, subjecting the first treatment liquid contained in the digester to circulation within the digester by withdrawing the first treatment liquid from the middle liquid exchange position and reintroducing the withdrawn first treatment liquid to a top and a bottom of the digester, passing the first treatment liquid through the comminuted cellulosic material disposed in the digester at least once, and washing out the carbohydrates dissolved in the hydrolysate;

in a first draining phase, draining the first treatment liquid from the digester via one of the middle or bottom liquid exchange positions to obtain a strong first liquid; and sending at least a part of the strong first liquid to a dedicated processing position either for use in a different phase of the batch pulping process or for further processing wherein at least a part the strong first liquid is used for recovering by-products;

wherein the first treatment liquid is used during prehydrolysis of the comminuted cellulosic material to produce an acidic hydrolysate containing the carbohydrates dissolved in the hydrolysate during the prehydrolysis and wherein after the first draining phase at least a part of the strong first liquid is sent to further processing in a sugar recovery process by using the carbohydrates dissolved in the hydrolysate; and wherein after the first draining phase, the digester is filled with water until the comminuted cellulosic material is submerged in the water, the water is subjected to circulation, in a second draining phase, the water is drained from the digester via one of the middle or bottom liquid exchange positions to obtain a weak first liquid and at least a part of the weak first liquid is sent to a dedicated second accumulator to be used as being part of the first treatment liquid ahead of prehydrolysis in a subsequent batch cycle.

* * * * *